US006066925A

United States Patent [19]

Lehmann

[11] Patent Number: 6,066,925

[45] Date of Patent: May 23, 2000

[54] CAPACITIVE DISCHARGE-LIGHTING OF AN INCANDESCENT LAMP

[76] Inventor: Peter H. Lehmann, 8723 West Chester Pike, Upper Darby, Pa. 19082

[21] Appl. No.: 08/892,388

[22] Filed: Jul. 14, 1997

[51] Int. Cl.[7] ..... H05B 37/00

[52] U.S. Cl. ..... 315/200 A; 315/291; 315/209 R; 315/241 R

[58] Field of Search ..... 315/209 R, 194, 315/208, 246, 291, 241 R, 241 S, 200 A; 362/293, 184

[56] References Cited

U.S. PATENT DOCUMENTS

| | | | |
|---|---|---|---|
| 3,824,447 | 7/1974 | Kuwabara | 321/15 |
| 4,097,782 | 6/1978 | Chambliss | 315/209 R |
| 4,200,823 | 4/1980 | Keeran et al. | 315/241 R |
| 4,835,665 | 5/1989 | Kao | 362/184 |

*Primary Examiner*—Don Wong
*Assistant Examiner*—Haissa Philogene

[57] ABSTRACT

The peak voltage of a periodic capacitive discharge, applied across first and second electrodes of the incandescent lamp, is about equal to the nominal DC voltage of the lamp multiplied by 3.2. The repetition rate of discharging, the extent of charging and discharging, and the value of the capacitance producing the periodic discharge result in the values of momentary peak and nominal temperature of the filament of the lamp being equal. Thereby, the value of peak luminous flux emission with respect to the nominal luminous flux emission of the lamp is several times greater. Where the discharge is periodic at a rate equal to about 14. HZ, then luminous flux emission by the lamp appears to the human eye to be continuously bright at an intensity equal to the peak value of luminous flux emission of the lamp, and the emission of the lamp is suitable for providing illumination. Emission of the lamp is suitable for providing emergency flashing where the discharge is periodic at a rate equal to about 1. HZ. A plurality of capacitors charged in parallel and discharged in series, as opposed to charging and discharging a single capacitor, can reduce the necessary voltage of the power supply providing the capacitive charge.

20 Claims, 5 Drawing Sheets

CAPACITIVE DISCHARGE-LIGHTING OF AN INCANDESCENT LAMP

BACKGROUND

1. Field of Invention

This invention relates to portable self-powered incandescent lighting devices, specifically to improving the ratio of apparent continuous luminous flux emission with respect to wattage of such devices providing illumination, and providing for alternate illuminating and emergency flashing operation of such devices.

2. Description of Prior Art

First and second types of miniature incandescent flashlight bulbs include a filling of krypton gas and a halogen, respectively. The rated or nominal luminous flux emitted by these first two types of bulb is greater than the nominal luminous flux emitted by a third type of miniature incandescent bulb including a tungsten filament and a filling consisting of nitrogen and argon gases. However, the ratio of nominal luminous flux with respect to nominal direct current (DC) wattage of the first and second types, with respect to that of the third type, shows no improvement. Therefore, a portable self-powered lighting device including a bulb of the first or second types as opposed to the third type provides improved intensity of illumination, but also decreased service life of the battery pack of the lighting device.

Supply voltage pulsing circuitry for reducing average wattage of lighting an incandescent lamp without reducing apparent luminous flux emission by the lamp is disclosed by U.S. Pat. No. 4,097,782 to Chambliss (1978). A periodic duty cycle of less than 100% on time is of a minimum time interval allowing the filament of the lamp to momentarily attain the planned or nominal temperature of continuous lighting. Thereby, peak luminous flux emitted by the lamp equals the nominal value of luminous flux emission of the lamp. Where the pulse repetition rate (PRR) of the on- time pulse is equal to about 14. Hertz (HZ), then the human eye perceives overlapping periods of retained images of peak brightness.

It is known that lighting an incandescent lamp by a DC voltage that is greater than the nominal DC voltage of the lamp can result in improvement of the ratio of luminous flux emission with respect to wattage of the lamp, compared to the nominal value of that ratio. A plurality of capacitors charged in parallel and discharged in series can be utilized to obtain a momentary overvoltage for application across first and second electrodes of an incandescent bulb, with the advantage that the voltage of the power supply charging the plurality of capacitors can be considerably less than the voltage of such overvoltage. U.S. Pat. No. 3,824,447 to Kuwabara (1974) discloses such plurality of capacitors wherein false discharging loops of such plurality of capacitors are interrupted by rendering either the source to drain channel of a metal oxide-silicon field effect transistor (MOS FET), or a diode, non-conductive. Where the energy stored by such plurality of capacitors is of a magnitude adequate to light a miniature incandescent lamp, then the MOS FETs of the circuitry for such plurality of capacitors, disclosed by Kuwabara, must be power-type MOS FETs. As a result, interruption of a false discharging loop of circuitry of such plurality of capacitors by rendering the source to drain channel of a power MOS FET as opposed to a diode, non-conductive, is not cost effective.

U.S. Pat. No. 4,835,665 to Kao (1989) discloses an emergency flashlight. The emergency flashlight includes first and second lamps for illumination and emergency flashing, light gathering and focusing elements, and main and auxiliary battery power supplies, respectively. A supply voltage pulsing circuit of the emergency flashlight produces bright bursts of light of the emergency flashing lamp only. The duplication of functional elements providing illumination and emergency flashing by the emergency flashlight, and dedication of the pulsing circuit to the flashing operation of the emergency flashlight only, is inefficient structural design. Also, in most cases, the two functions of the emergency flashlight, of providing illumination and emergency flashing, would be alternately selected.

OBJECTS AND ADVANTAGES

Several objects and advantages of my invention are to provide for a portable self-powered lighting device including a miniature incandescent lamp, wherein:

(a) the ratio of peak luminous flux emission by the lamp with respect to average wattage of the device is several times greater than the ratio of the nominal luminous flux emission with respect to the nominal DC wattage of the lamp;

(b) momentary peak operating and nominal temperatures of the filament of the lamp are equal, with the result that the operating service life of the lamp is moderately reduced in comparison with the nominal service life of the lamp;

(c) the lighting device can include circuitry for user-switched alternate selection of first and second repetition rates of momentary peak luminous flux emission by the lamp equal to about 14. HZ and 1. HZ, respectively, so that a user can easily alternate operation of the lighting device to provide illumination or emergency flashing;

(d) operation of the lighting device including the first repetition rate of momentary peak luminous flux emission about equal to 14. HZ causes the peak level of illumination provided by the lamp to appear to the human eye as continuous illumination of a level equal to the actually occurring peak level;

(e) a single power supply, a single lamp supply circuit, and the lamp are the components of the lighting device alternately functioning to provide illumination or emergency flashing, so that an economical lighting device of dual purpose is accomplished;

(f) the user operates the lighting device to provide illumination, then some flickering of the emission of the lamp is apparent to the human eye, such flickering attracting the attention of and warning others of the presence of the user in the selfsame area to an extent greater than would be accomplished if such emission did not include some flickering.

Additional objects and advantages of my invention will become apparent from a consideration of the drawings and ensuing description.

DRAWING FIGURES

Figure 2:
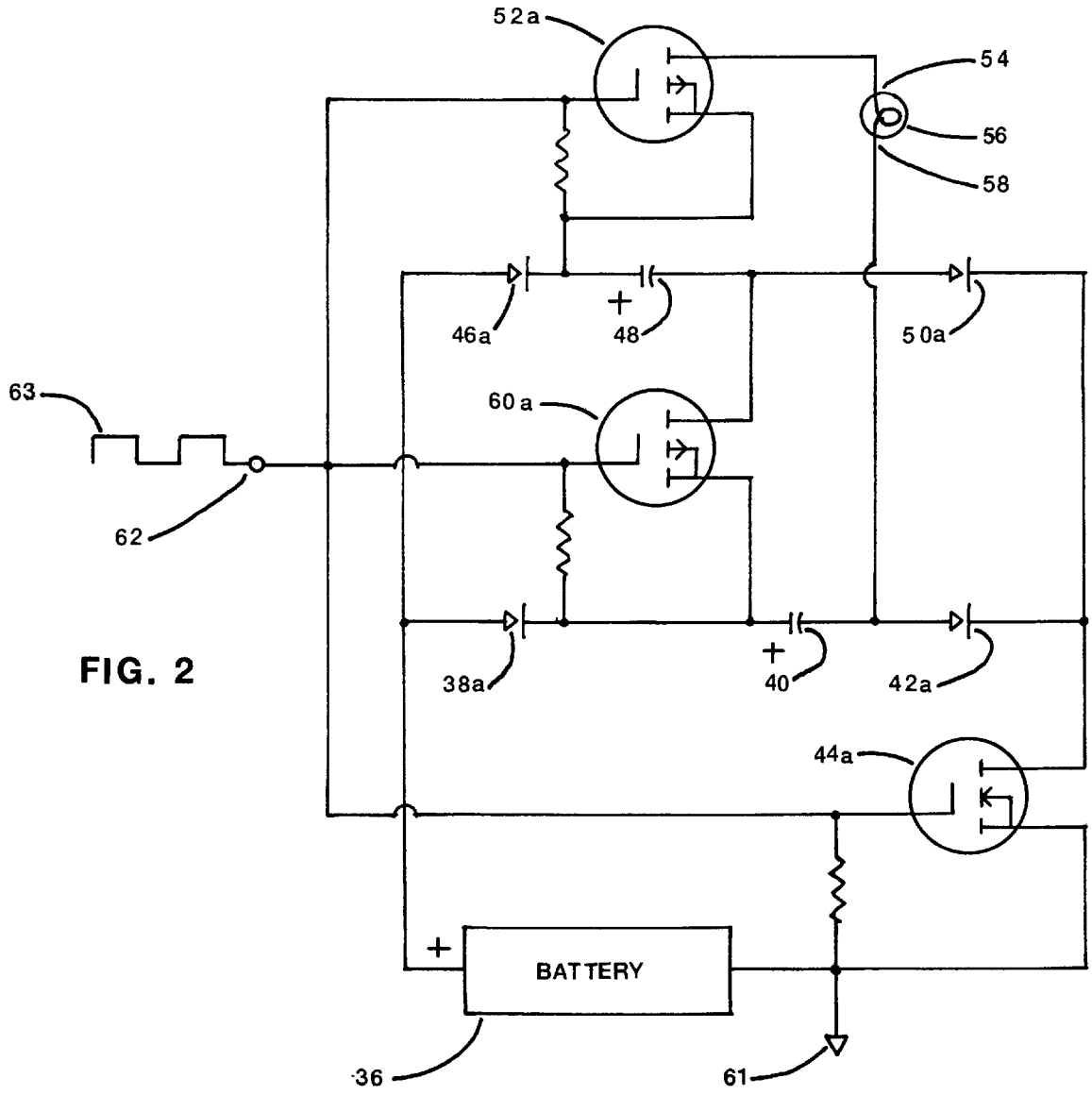
FIG. 2 shows a schematic circuit diagram illustrating a second embodiment of my invention including first and second energy storing capacitors charged in parallel and discharged in series.

FIG. 3, FIG. 4, FIG. 5, and FIG. 6 are explanatory circuit diagrams with reference to the circuit shown at FIG. 2, each figure demonstrating interruption of a false discharging loop by a diode rendered non-conductive.

Figure 7:
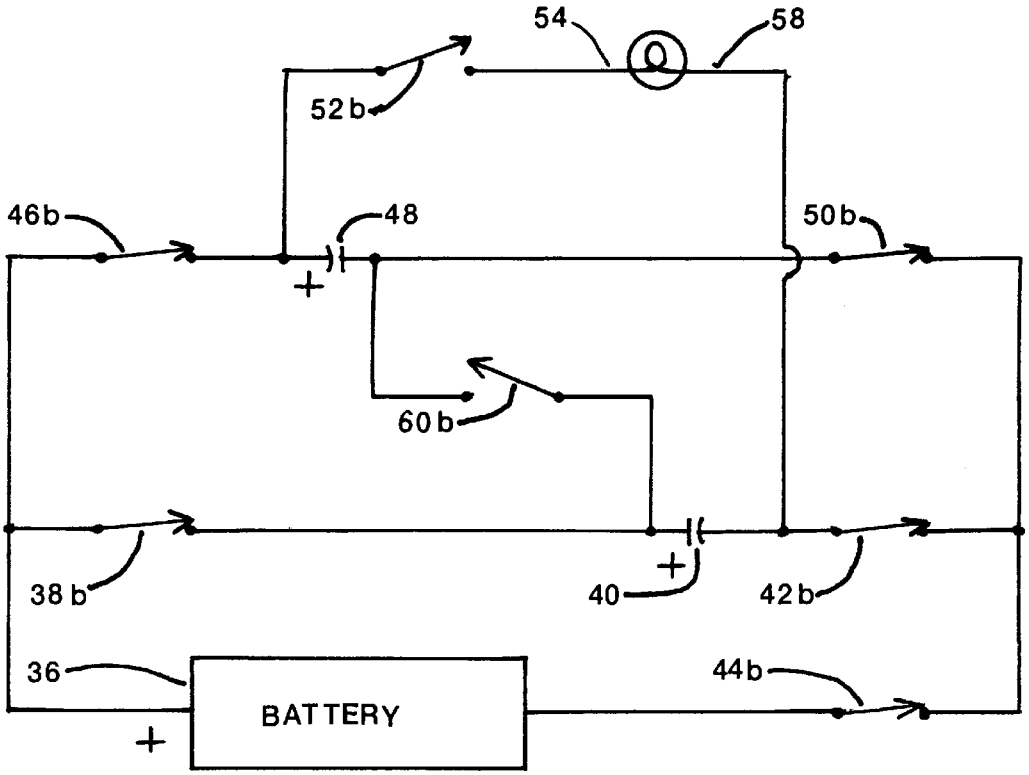

FIG. 7 is an equivalent circuit diagram showing charging of the first and second energy storing capacitors of FIG. 2.

Figure 8:
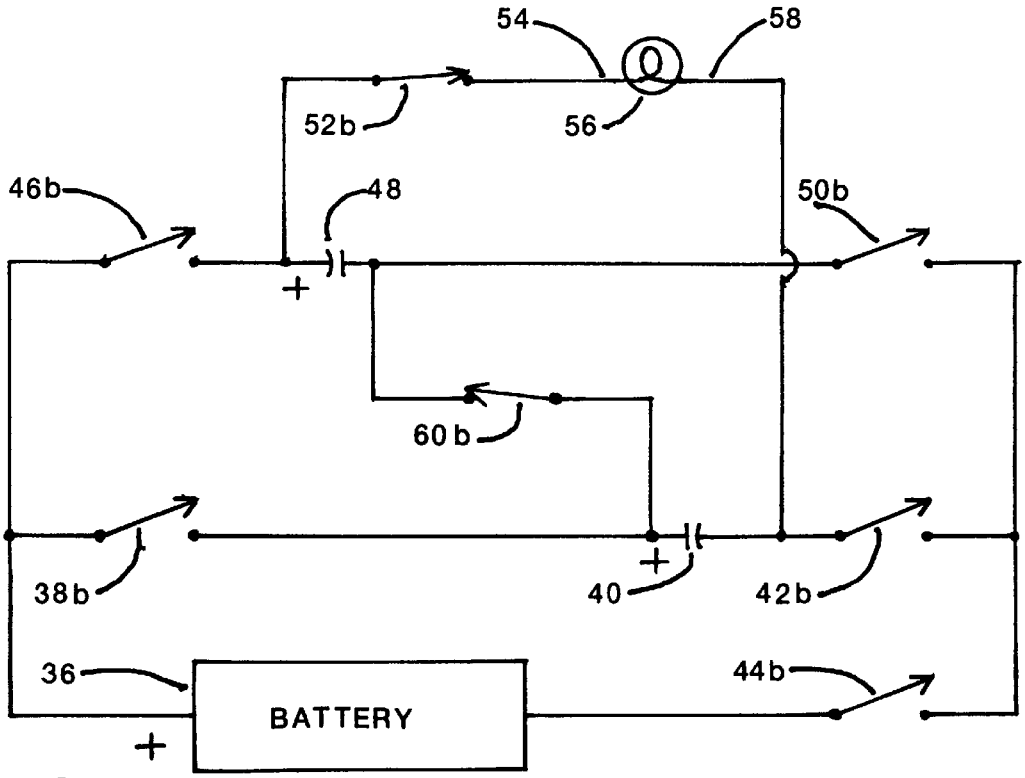

FIG. 8 is an equivalent circuit diagram showing discharging of the first and second energy storing capacitors of FIG. 2.

Figure 9:
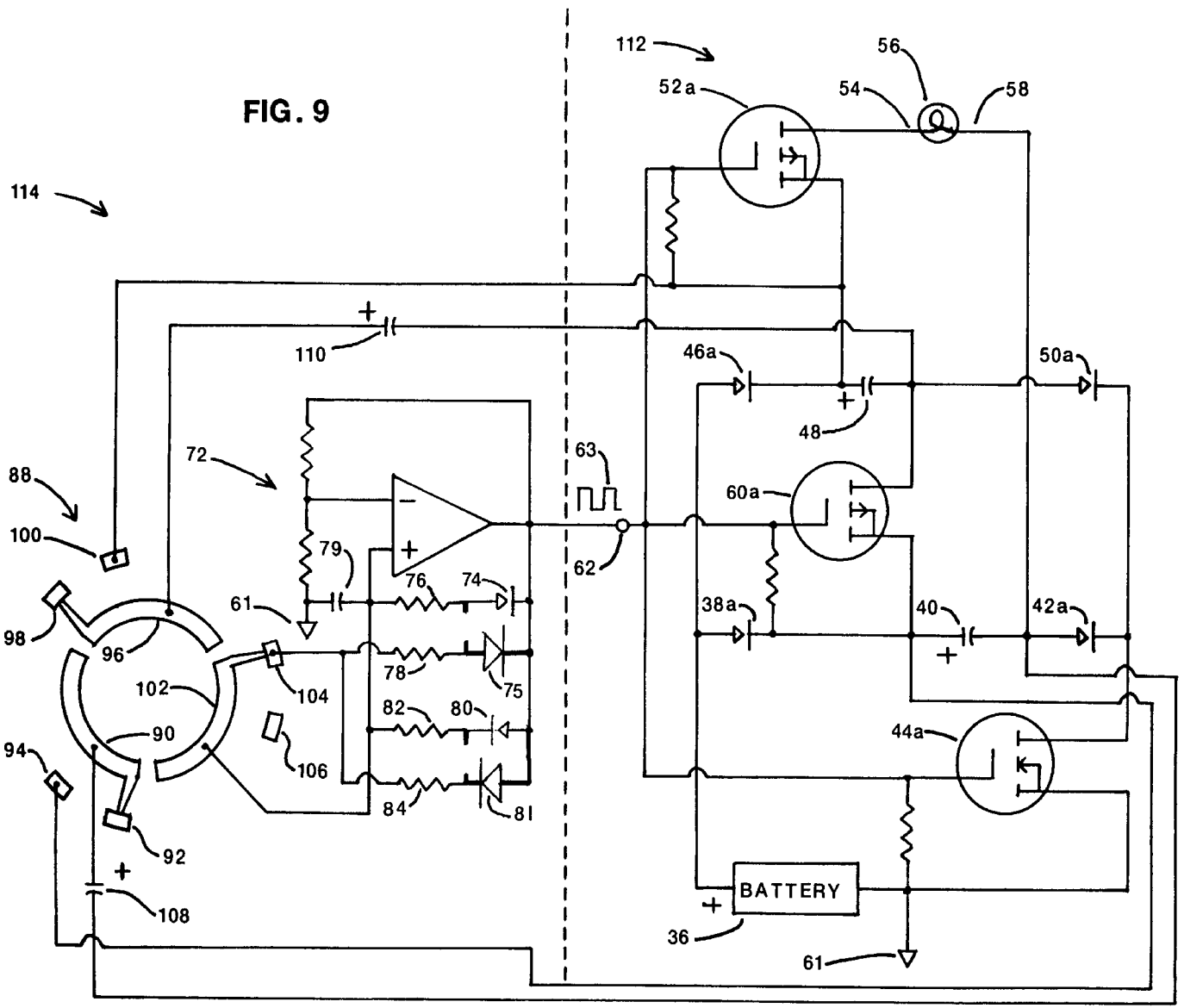
Figure 1:
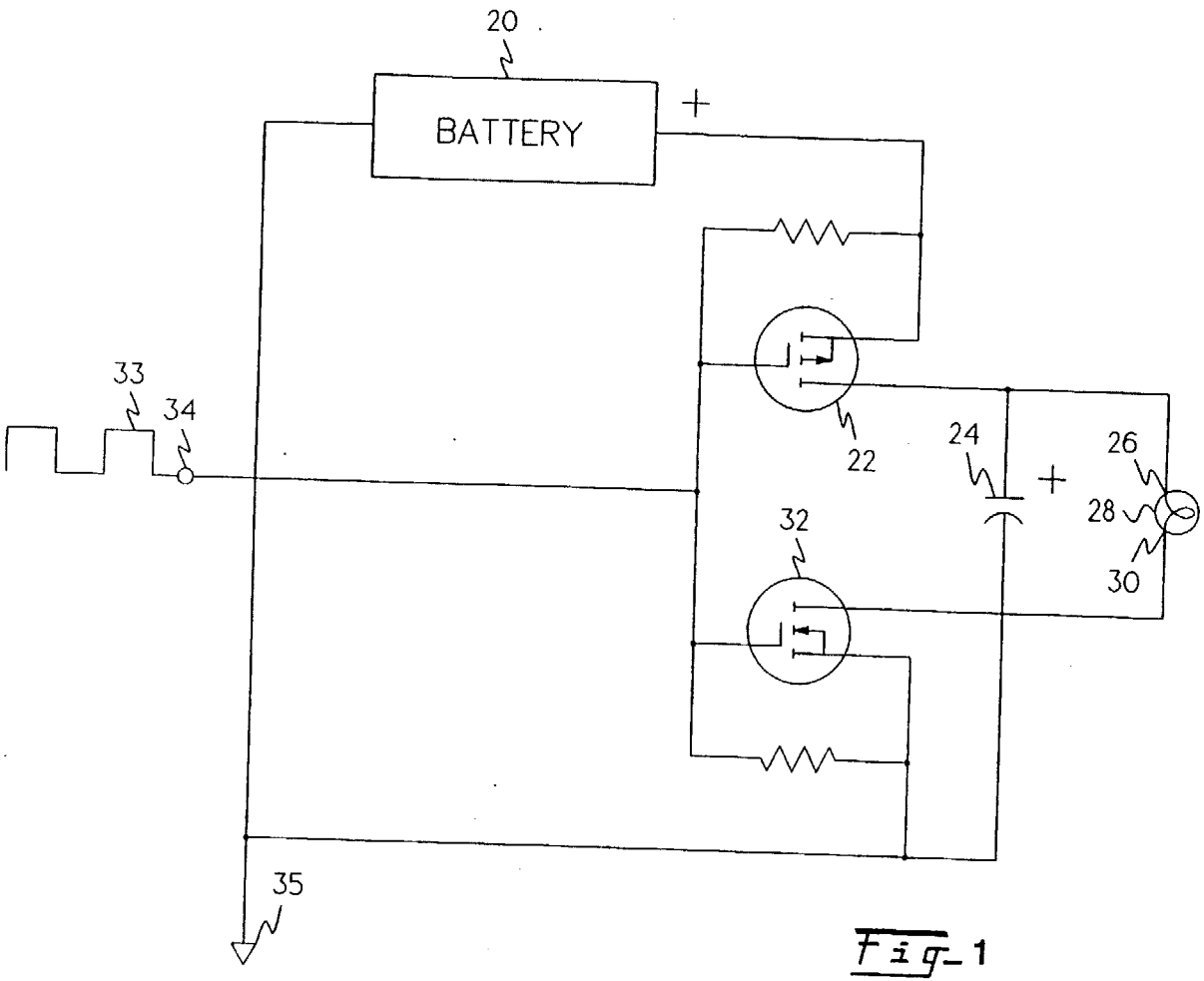
Figure 2:
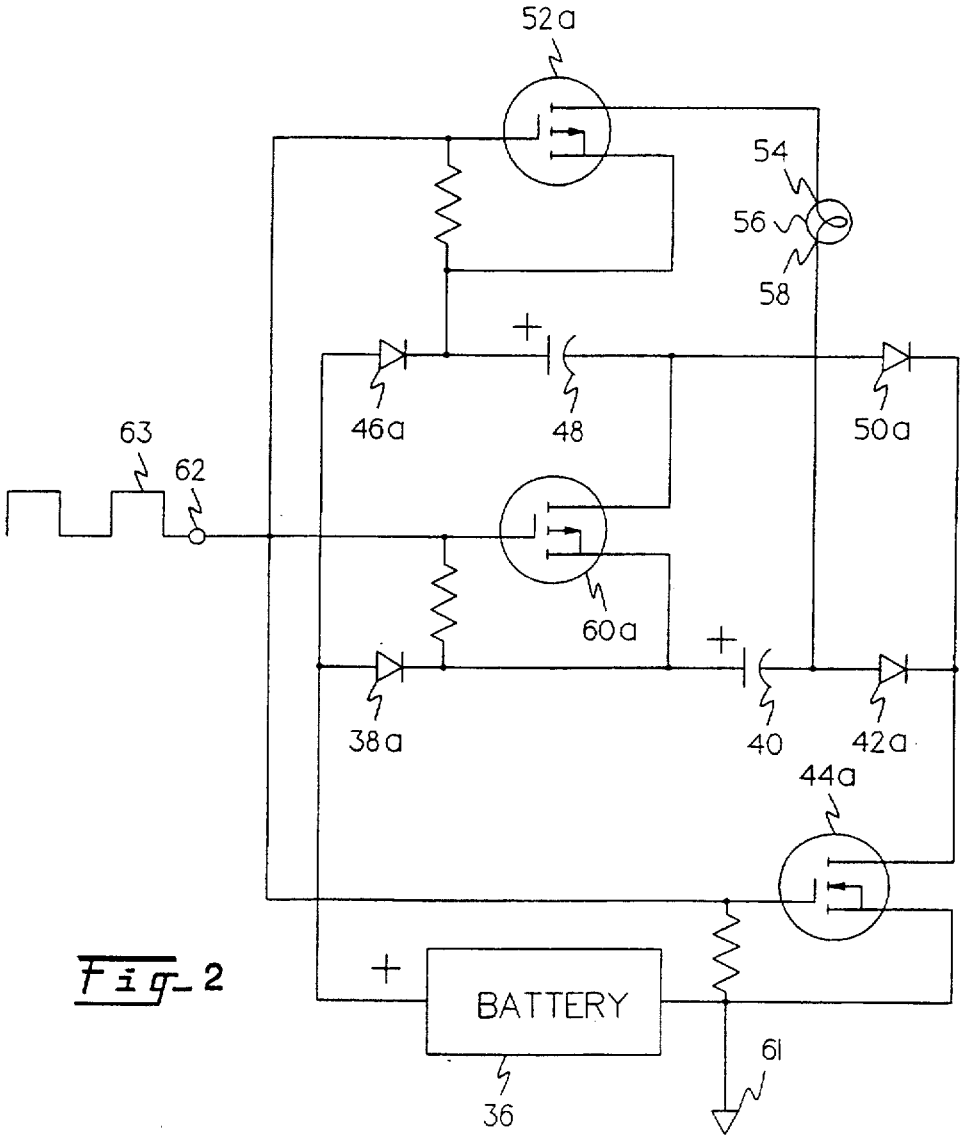
Figure 3:
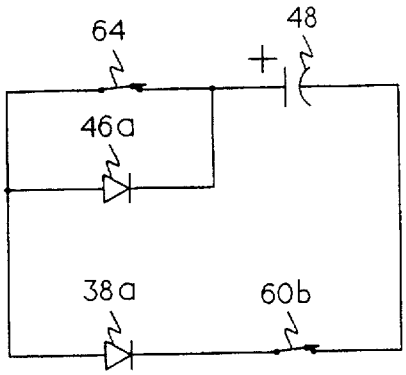
Figure 4:
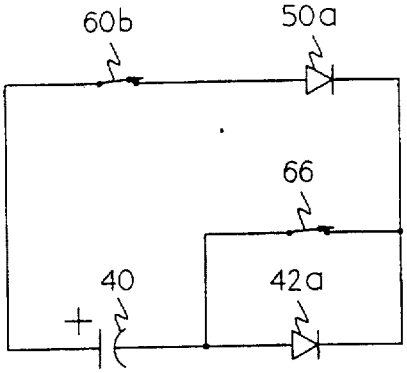
Figure 5:
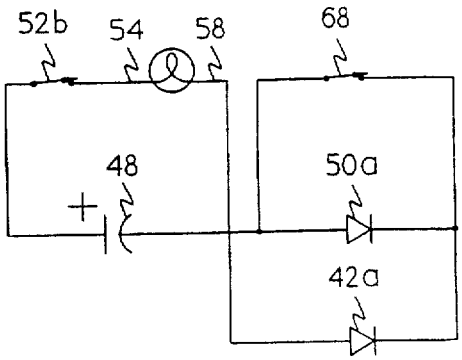
Figure 6:
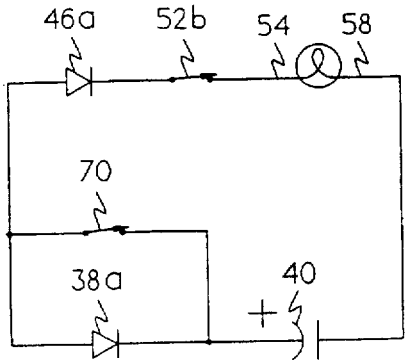
Figure 7:
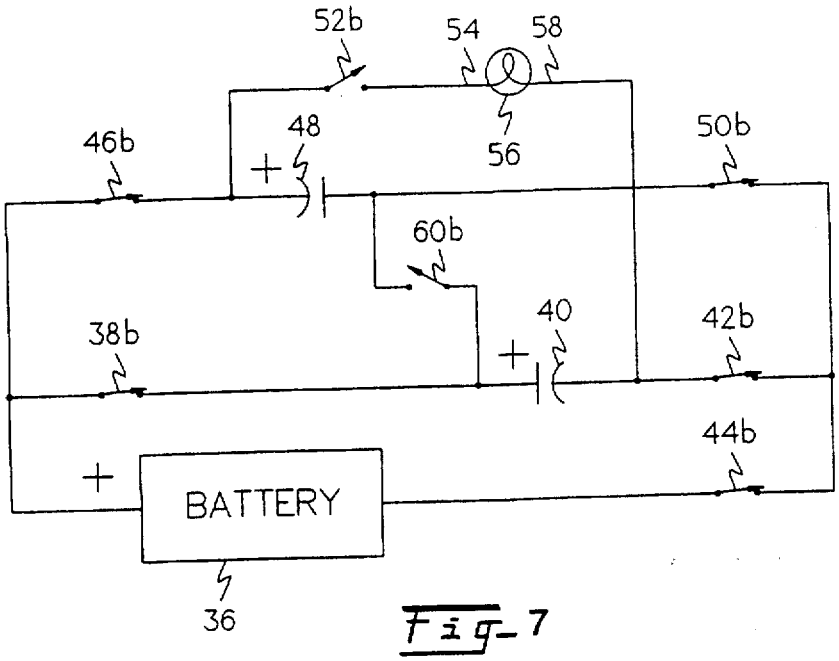
Figure 8:
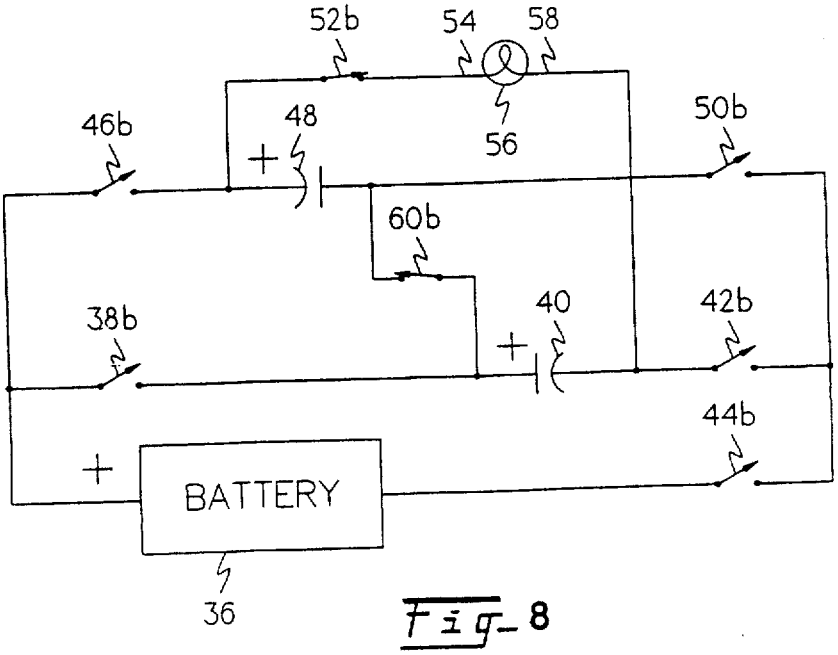
Figure 9:
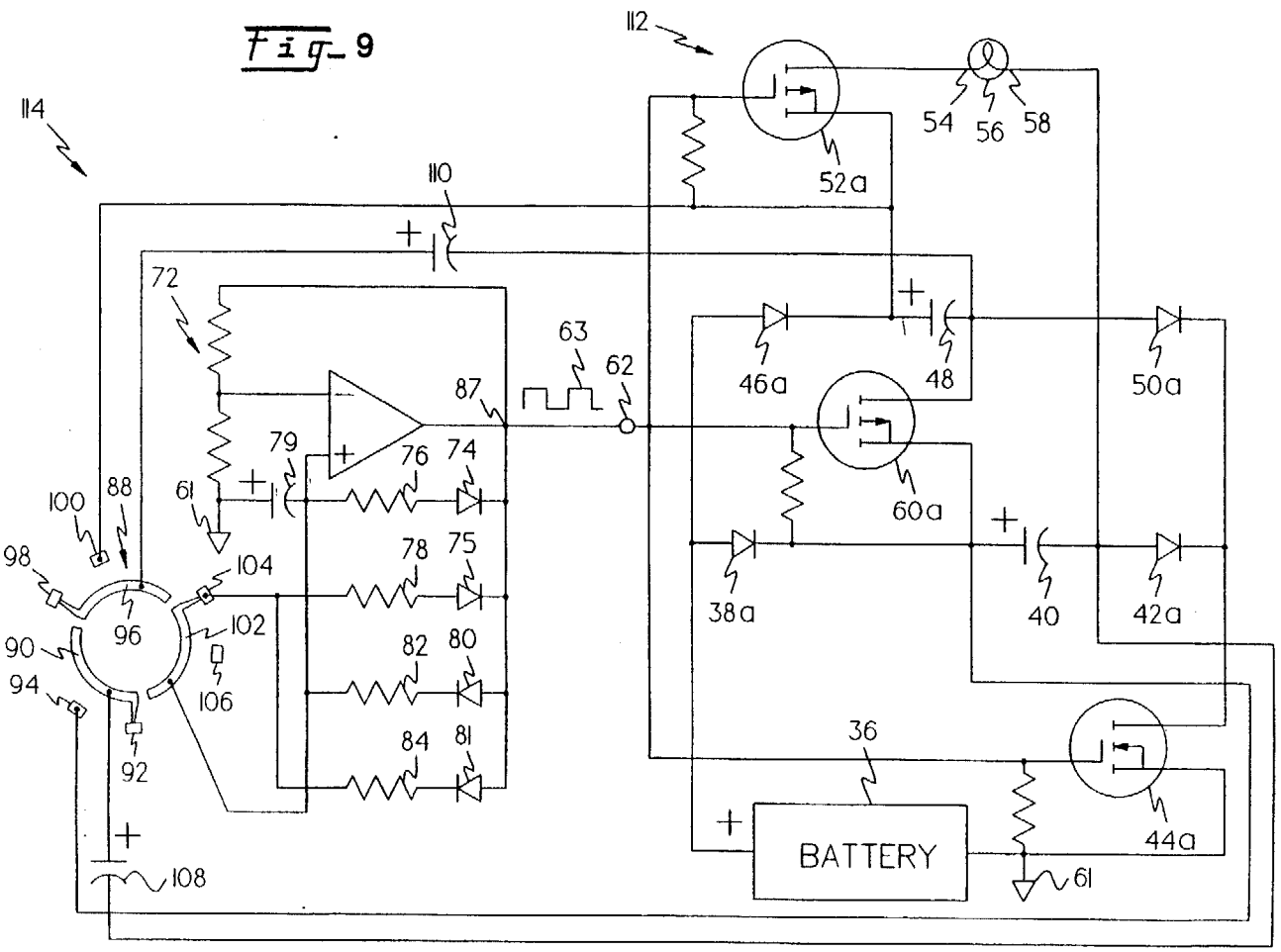

FIG. 9 shows a schematic circuit diagram of a third and preferred embodiment according to my invention, including the circuit schematically presented at FIG. 2.

Reference Numerals in Drawings

| | | | |
|---|---|---|---|
| 20 | DC power supply | 22 | P-channel MOS FET |
| 24 | energy storing capacitor | 26 | first electrode |
| 28 | flashlight bulb | 30 | second electrode |
| 32 | N-channel MOS FET | 33 | square wave control signal |
| 34 | control signal input terminal | 35 | reference potential terminal |
| 36 | DC power supply | 38a | first interrupting diode |
| 38b | equivalent switch | 40 | first energy storing capacitor |
| 42a | second interrupting diode | 42b | equivalent switch |
| 44a | N-channel MOS FET | 44b | equivalent switch |
| 46a | third interrupting diode | 46b | equivalent switch |
| 48 | second energy storing capacitor | 50a | fourth interrupting diode |
| 50b | equivalent switch | 52a | first P-channel MOS FET |
| 52b | equivalent switch | 54 | first electrode |
| 56 | flashlight bulb | 58 | second electrode |
| 60a | second P-channel MOS FET | 60b | equivalent switch |
| 61 | reference potential terminal | 62 | control signal input terminal |
| 63 | square wave control signal | 64 | first shorting switch |
| 66 | second shorting switch | 68 | third shorting switch |
| 70 | fourth shorting switch | 72 | astable multivibrator |
| 74 | first switching diode | 76 | first feedback resistor |
| 75 | third switching diode | 79 | timing capacitor |
| 78 | second feedback resistor | 82 | third feedback resistor |
| 80 | second switching diode | 87 | output terminal |
| 81 | fourth switching diode | 90 | first pole |
| 84 | fourth feedback resistor | 94 | second throw terminal |
| 88 | three pole, two position switch | 98 | fifth throw terminal |
| 92 | first throw terminal | 102 | third pole |
| 96 | second pole | 106 | tenth throw terminal |
| 100 | sixth throw terminal | 110 | second auxiliary capacitor |
| 104 | ninth throw terminal | 114 | control signal generator and mechanical switching circuitry |
| 108 | first auxiliary capacitor | | |
| 112 | lighting circuit | | |

SUMMARY

In accordance with my invention, an incandescent lamp is lighted by a capacitive discharge, wherein the ratio of the peak voltage of the capacitive discharge to nominal DC voltage of the lamp is about equal to 3.2, and the period of lighting of the lamp is such that the momentary peak and nominal values of temperature of the filament of th e lamp are equal.

Figure 1:
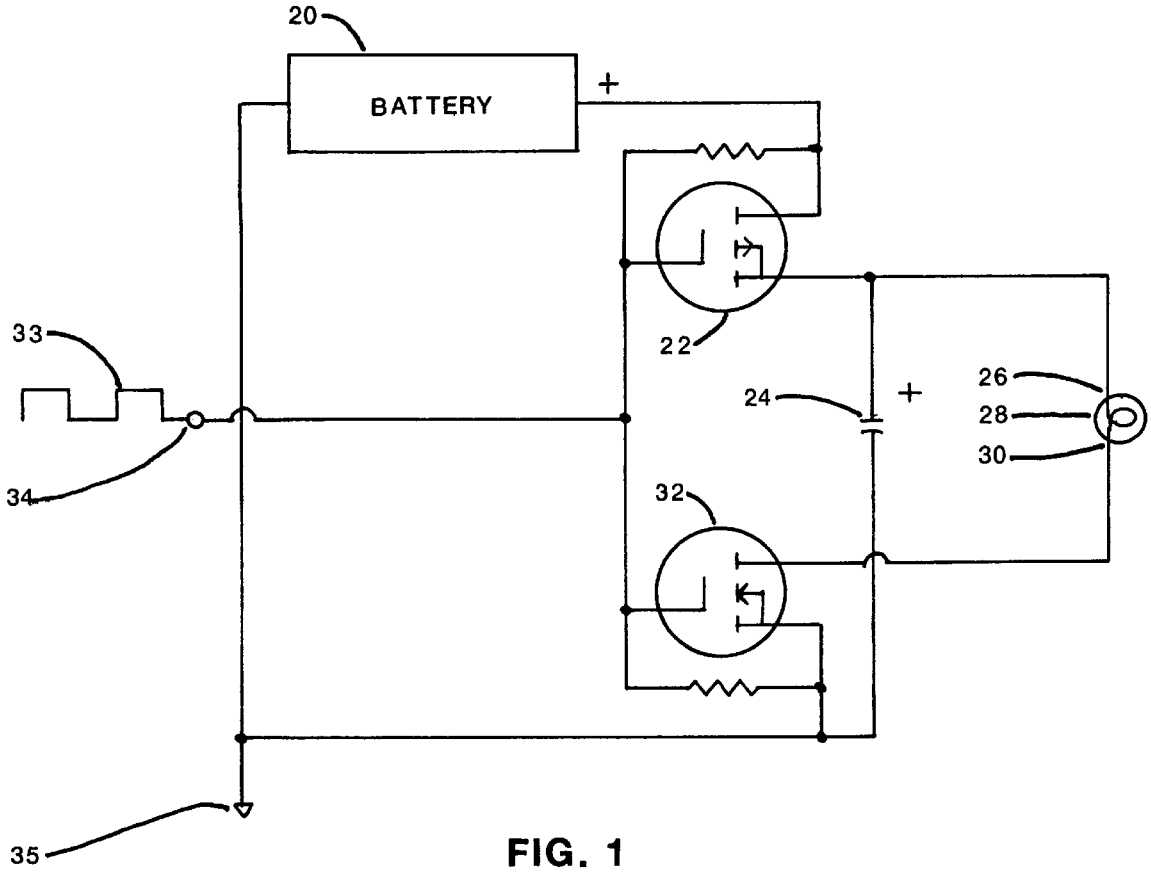
FIG. 1 shows a schematic circuit diagram of a first elementary embodiment according to my invention, including a single energy storing capacitor.

Description—FIG. 1

A first elementary embodiment according to my invention, including a single energy storing capacitor, is shown at FIG. 1. The circuit of FIG. 1 includes a charging loop and a discharging loop, both loops including energy storing capacitor 24, and circuitry for controlling the periodic terms of charging and discharging of capacitor 24 by square wave control signal 33.

The charging loop of FIG. 1 consists of the following. Source and drain terminals of P-channel MOS FET 22 are connected to the positive terminal of battery or DC power supply 20 and the positive terminal of energy storing capacitor 24, respectively. Negative terminals of capacitor 24 and DC power supply 20 are connected together.

The following describes the discharging loop of FIG. 1. Positive and negative terminals of capacitor 24 are connected to first electrode 26 of flashlight bulb 28 and the source terminal of N-channel MOS FET 32, respectively. Second electrode 30 of bulb 28 is connected to the drain terminal of N-channel MOS FET 32.

The operational mode of the circuit of FIG. 1 is controlled by the application of signal 33, with respect to reference potential terminal 35, to control signal input terminal 34 connected together with the gate terminals of MOS FETs 22 and 32.

MOS FETs 22 and 32 are power MOS FETs equal or equivalent to the type of FET including the prefix, IRF, manufactured by International Rectifier, of El Segundo, Calif., U.S.A.

Operation—FIG. 1

Signal 33 of FIG. 1 abruptly alternates between a first signal level and a second signal level. The first signal level, with respect to the voltage taken at terminal 35, is equal or nearly equal to 0. volts. The second signal level, with respect to the voltage taken at terminal 35, is equal or nearly equal to the positive voltage of power supply 20, $E_1$.

With signal 33 residing at the first signal level, then capacitor 24 of FIG. 1 is charged. Signal 33 is applied to terminal 34 connected together with the gate terminals of MOS FETs 22 and 32. As a result, the source to drain connections of MOS FETs 22 and 32 are rendered conductive and interrupted, respectively. As a result, the charging loop of FIG. 1 is conductive, and the discharging loop of FIG. 1 is interrupted.

With signal 33 residing at the second signal level, then capacitor 24 of FIG. 1 is discharged. That is, signal 33 residing at the second signal level results in the source to drain connections of MOS FETs 22 and 32 interrupted and rendered conductive, respectively. An additional result is that the charging and discharging loops of the circuit of FIG. 1 are interrupted and conductive, respectively.

According to my invention, the circuit of FIG. 1 is made to operate such that the momentary peak and nominal values of temperature of the filament of bulb 28 are equal. The nominal value of temperature of the filament of bulb 28 is the temperature of the filament of a flashlight bulb that is of an identical bulb-type as bulb 28 and lighted by the nominal DC voltage corresponding to the bulb-type. As a result, the service life of bulb 28 is not unnecessarily reduced.

The circuit of FIG. 1 can be operated such that capacitor 24 is periodically fully charged and then fully discharged. Work done to charge capacitor 24 is equal to $W_C$. The discharging time constant of the discharging loop of FIG. 1 is equal to taud. Therefore, the average rate of doing the work of lighting bulb 28 by the discharge of capacitor 24 is equal to $W_C/5\text{tau}_d$.

Given first and second simplifying assumptions concerning the operation of the circuit of FIG. 1, $$W_C/5tau_d=0.5C_{24}(E_1)^2/5R_{lh}nom.C_{24}$$

where $C_{24}$ is equal to the capacitance of capacitor 24, and $R_{lh}$nom.is equal to the nominal hot resistance value of the filament of bulb 28. The first simplifying assumption is that when bulb 28 is lighted by the discharge of capacitor 24, then the actually fluctuating resistance value of the filament of bulb 28 is treated as equal to Rlhnom. The second simplifying assumption is that the resistance value of the source to drain connection of MOS FET 32 rendered conductive is negligible with respect to the cold resistance value of the filament of bulb 28.

According to my invention, a first step taken to cause the circuit of FIG. 1 to operate such that the momentary peak and nominal values of temperature of the filament of bulb 28 are equal is to equate average wattage of discharge of capacitor 24 to the nominal wattage of bulb 28:

$$05C_{24}(E_1)^2/5R_{1h}nom.C_{24}=(V_1nom.)^2/R_{1h}nom.$$

$$E_1=3.2V_1nom.$$

where $V_l$nom. is equal to the nominal DC voltage of bulb 28.

Continuing to refer to FIG. 1, for the purpose of minimizing the required value of $E_l$, the period of residence of signal 33 at the first signal level, $PW_c$, causes the peak voltage of capacitor 24, with respect to the voltage taken at terminal 35, to be equal to $E_l$. Calculation of the necessary term of $PW_c$ is difficult, as the internal resistance and current drain of power supply 20 are in direct proportion, and the tolerance value of electrolytic capacitor 24 is generally equal to +/−20%. In addition, a first method of operation of the circuit of FIG. 1 according to my invention includes incomplete discharging of capacitor 24. The necessary term of $PW_c$ can be empirically established by measuring the peak voltage drop across the positive and negative terminals of capacitor 24 on the screen of an oscilloscope corresponding to a trial value of the term of $PW_c$ selected.

In accordance with the first method of operation of the circuit of FIG. 1 for illumination, the pulse repetition rate (PRR) of the period of residence of signal 33 at the second level, $PW_d$, is about equal to 14. HZ. Such PRR about equal to 14. HZ is a threshold value causing image retention of periods of peak brightness by the human eye to overlap.

The PRR of signal 33 is equal to the inverse of the summation of the terms of period of residence of signal 33 at first and second signal levels. $Tau_c$avg. is equated to the average time constant of the charging loop of FIG. 1. Trial and error experimentation by the inventor indicates that, in general, $PW_c$ must be very nearly equal to $5tau_c$avg. if the PRR of signal 33 can be about equal to 14. HZ.

According to a second method of operation of the circuit of FIG. 1 for emergency flashing, the PRR of signal 33 is about equal to 1. HZ. $Tau_d$avg. is equated to the average time constant of the discharging loop of FIG. 1. Such second method of operation is most effective provided that $PW_c$ and $PW_d$ are equal to greater than $5tau_c$avg., and $5tau_d$avg., respectively. Such effectiveness derives from producing as high a value of $W_C$ of capacitor 24 as possible.

Where the circuit of FIG. 1 is operated according to the first method, the PRR of signal 33 is about equal to 14. HZ. Empirical evidence of the inventor indicates that in general the term of $PW_d$ must be equal to less than $5tau_d$avg. if the PRR of signal 33 can be about equal to 14. HZ. The period of overvoltage of bulb 28 by the discharge of capacitor 24 is the cause of the momentary peak luminous flux emission by bulb 28 in excess of the value of nominal luminous flux emission of bulb 28. Therefore, such first method of operation includes a term of $PW_d$ causing a cessation of discharge of capacitor 24 when the voltage drop across the positive and negative terminals of capacitor 24 is equal to $V_l$nom. That is, the term of $PW_d$ is equal to 1.2 $tau_d$avg. corresponding to a ratio of ending to peak voltage drop across the positive and negative terminals of capacitor 24 equal to 0.31. With respect to heating of the filament of bulb 28, the percentage loss of work done by the incomplete discharge of capacitor 24 is about equally offset by a decrease of drooping of the temperature of the filament of bulb 28 caused by a corresponding increase of PRR of signal 33.

Where the circuit of FIG. 1 is operated according to the second method, then the term of $PW_d$ can be made equal to $5tau_d$avg. and the PRR of signal 33 remains equal to 1. HZ. The advantage to making the term of $PW_d$ equal to $5tau_d$avg. is to offset an increase of drooping of the temperature of the filament of bulb 28 during the term of $PW_c$, with respect to such drooping occurring when the circuit of FIG. 1 is operated according to the first method.

Several varying factors cause difficulty in calculating the value of $tau_d$avg. of the discharging loop of FIG. 1. A first factor is that the tolerance value of electrolytic capacitor 24 is equal to +/−20%. A second factor is that the ratio of the resistance of the filament of bulb 28 when heated to the nominal temperature of bulb 28, with respect to when the filament of bulb 28 is cold, is about equal to ten. The instantaneous rate of heating of the filament of bulb 28 directly proportional to the instantaneous wattage of discharge of capacitor 24 is a third factor. The required term of $PW_d$ can be empirically established by measuring the ending capacitve discharge voltage drop across the positive and negative terminals of capacitor 24 on the screen of the oscilloscope, corresponding to a selected trial value of $PW_d$.

The filament of bulb 28 of FIG. 1 has some characteristic inertia of heating. The peak discharging voltage of capacitor 24 is equal to 3.2 $V_l$nom. Therefore, as a function of the temperature of the filament of bulb 28 at the time point when $PW_d$ is initiated, and the value of $tau_d$avg., such inertia of heating can be surpassed at a time point when the instantaneous voltage of discharge of capacitor 24 with respect to time is greater than $V_l$nom. As a result, the filament of bulb 28 is overheated and the service life of bulb 28 is severely reduced.

Conversely, selection of a proper value of capacitance of capacitor 24 can result in the momentary peak and nominal values of temperature of the filament of bulb 28 being equal. Therefore, a second step taken to avoid overheating the filament of bulb 28 is selection of a proper value of capacitance of capacitor 24. An unexpected result thereby obtained is that the peak luminous flux emission of bulb 28 is several times greater than the value of nominal luminous flux emission of bulb 28.

Selecting the proper value of capacitor 24 of FIG. 1 is accomplished by trial and error. A test bulb of a bulb-type identical to that of bulb 28 of FIG. 1 is periodically lighted by an on-pulse of a DC voltage equal to $V_l$nom. A minimum value of duty cycle is selected resulting in the values of measured operational peak and nominal luminous flux emission of the test bulb being equal. As a result, the values of momentary peak and nominal temperature of the filament of the test bulb are also equal. A tabulation of reference bulb-surface temperatures corresponding to the PRR of the on-pulse is generated by measuring the temperature of the exterior glass surface of the test bulb for values of PRR of the on-pulse equal to 1. HZ, and in the range of 10. HZ to 14. HZ. Selection of the proper capacitance value of capacitor 24 results in the measured temperature of the exterior glass bulb of bulb 28 equal to the reference bulb-surface temperature where the PRR of signal 33 of FIG. 1 and the on-pulse are equal.

Description—FIGS. 2 to 8

FIG. 2 is a schematic circuit diagram of a second embodiment of my invention including first and second capacitors charged in parallel and discharged in series.

A first charging loop of the circuit of FIG. 2 consists of the following. Positive and negative terminals of battery or DC power supply 36 are connected to the anode terminal of first interrupting diode **38*a* and the source terminal of N-channel MOS FET 44*a*, respectively. Positive and negative terminals of first energy storing capacitor 40 are connected to the cathode terminal of diode 38***a* and the anode terminal of second interrupting diode 42*a*, respectively. Connecting the cathode terminal of diode 42*a* to the drain terminal of MOS FET 44*a* closes the first charging loop.

A second charging loop of FIG. 2 includes the positive and negative terminals of supply 36 connected to the anode terminal of third interrupting diode 46*a* and the source terminal of MOS FET 44*a*, respectively. Additionally, the positive and negative terminals of second energy storing capacitor 48 are connected to the cathode terminal of diode 46*a* and the anode terminal of fourth interrupting diode 50*a*, respectively. The second charging loop is closed by connecting the cathode terminal of diode 50*a* to the drain terminal of MOS FET 44*a*. The values of capacitance of capacitors 40 and 48 are equal.

The discharging loop of FIG. 2 includes source and drain terminals of second P-channel MOS FET 60*a* connected to the positive terminal of capacitor 40 and the negative terminal of capacitor 48, respectively. In addition, source and drain terminals of first P-channel MOS FET 52*a* are connected to the positive terminal of capacitor 48 and first electrode 54 of flashlight bulb 56, respectively. The discharging loop is closed by connecting second electrode 58 of bulb 56 to the negative terminal of capacitor 40. For the purpose of explaining the operation of the circuit of FIG. 2, the bulb-type of bulb 56 is treated as identical to the bulb-type of bulb 28 of FIG. 1.

Periodic charging and discharging of capacitors 40 and 48 of FIG. 2 is effected by the application of square wave control signal 63 to control signal input terminal 62, with respect to the voltage taken at reference potential terminal 61. Terminal 62 is connected together with the gate terminals of MOS FETs 44*a*, 52*a*, and 60*a*.

Shown at FIGS. 7 and 8, the source and drain terminals of MOS FET 44*a* of FIG. 2 are equated to the pole and throw terminals of equivalent switch 44*b*, respectively. Referring to FIGS. 3,4,7, and 8, the source and drain terminals of MOS FET 60*a* of FIG. 2 are equated to the pole and throw terminals of equivalent switch 60*b*, respectively. FIGS. 5, and 6 to 8 show the source and drain terminals of MOS FET 52*a* of FIG. 2 equated to the pole and throw terminals of equivalent switch 52*b*, respectively.

Shown at FIGS. 7 and 8, diodes 38*a*, 42*a*, 46*a*, and 50*a* of FIG. 2 are equated to first equivalent switch 38*b*, second equivalent switch 42*b*, third equivalent switch 46*b*, and fourth equivalent switch 48*b*, respectively. The anode and cathode terminals of each diode 38*a*, 42*a*, 46*a*, and 48*a* of FIG. 2 are equated to the pole and throw terminals, respectively, of each corresponding equivalent switch shown at FIGS. 7 and 8.

Figure 3:
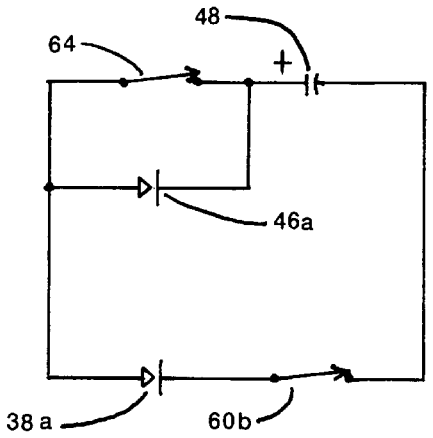

FIG. 3 is a first explanatory diagram showing interruption of a first false discharging loop of the circuit of FIG. 2 by diode 46*a* rendered non-conductive. The first false discharging loop consists of positive and negative terminals of capacitor 48 connected to the cathode terminal of diode 46*a* and the throw terminal of first shorting switch 64 connected together, and the throw terminal of switch 60*b*, respectively; and additionally, the anode and cathode terminals of diode 38*a* connected to the anode terminal of diode 46*a* and the pole terminal of switch 64 connected together, and the pole terminal of switch 60*b*, respectively.

Figure 4:
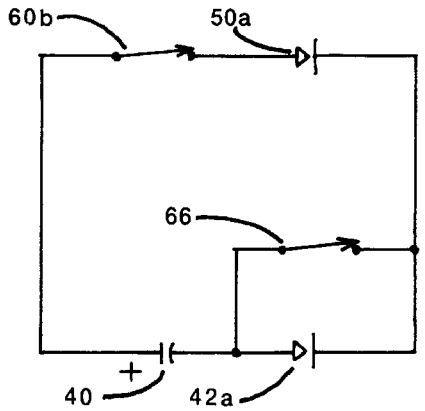

Shown at FIG. 4 is a second explanatory diagram of interruption of a second false discharging loop of the circuit of FIG. 2 by diode 42*a* rendered non-conductive. The explanatory diagram of FIG. 4 includes the positive and negative terminals of capacitor 40 connected to the pole terminal of switch 60, and the anode terminal of diode 42*a* and the pole terminal of second shorting switch 66 connected together, respectively. The loop of FIG. 4 is completed by the connection of the anode and cathode terminals of diode 50*a* to the throw terminal of switch 60*b*, and the cathode terminal of diode 42*a* and the throw terminal of switch 66 connected together, respectively.

Figure 5:
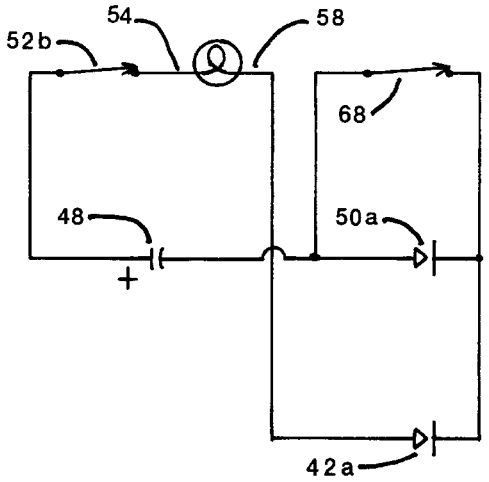

A third explanatory diagram, showing interruption of a third false discharging loop of the circuit of FIG. 2 by diode 50*a* rendered non-conductive, is given at FIG. 5. Included in the diagram of FIG. 5 is the positive and negative terminals of capacitor 48 connected to the pole terminal of switch 52*b*, and the anode terminal of diode 50*a* connected together with the pole terminal of third shorting switch 68, respectively. Also shown at FIG. 5 is electrode 54 connected to the throw terminal of switch 52*b*. The anode and cathode terminals of diode 42*a* connected to electrode 58, and the cathode terminal of diode 50*a* connected together with the throw terminal of switch 68, respectively, completes the third false discharging loop of FIG. 5.

Figure 6:
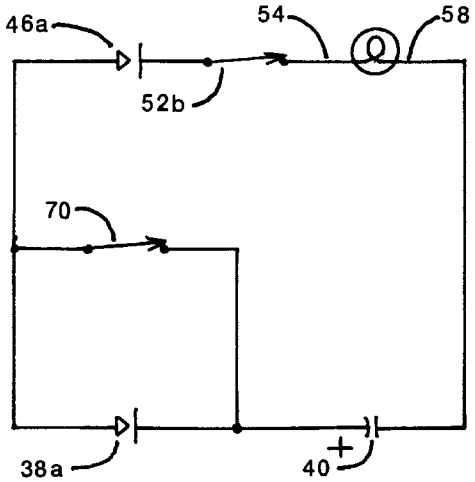

Diode 38*a*, rendered non-conductive and thereby interrupting a fourth false discharging loop of the circuit of FIG. 2, is explained by the diagram shown at FIG. 6. The fourth false discharging loop at FIG. 6 includes positive and negative terminals of capacitor 40 connected to the cathode terminal of diode 38*a* connected together with the throw terminal of fourth shorting switch 70, and electrode 58, respectively. Continuing to describe the loop of FIG. 6, the anode and cathode terminals of diode 46*a* are connected to the anode terminal of diode 38*a* connected together with the pole terminal of switch 70, and the pole terminal of switch 52*b*, respectively. The loop of FIG. 6 is completed by connection of the throw terminal of switch 52*b* to electrode 54.

Shown at FIG. 7 is a fifth explanatory diagram depicting charging of capacitors 40 and 48, of the circuit of FIG. 2, in parallel. FIG. 8 shows a sixth explanatory diagram depicting discharging of capacitors 40 and 48, of the circuit of FIG. 2, in series.

The first charging loop of FIG. 2 depicted at FIG. 7 includes first and second segments. The first segment consists of positive and negative terminals of capacitor 40 connected to the throw terminal of switch 38*b* and the pole terminal of switch 42*b*, respectively. The second segment consists of positive and negative terminals of supply 36 connected to the pole terminals of switches 38*b* and 44*b*, respectively. Connecting the throw terminals of switches 42*b* and 44*b* together completes the depiction of the first charging loop of FIG. 2 by FIG. 7.

The second charging loop of FIG. 2 depicted by FIG. 7 includes first and second segments. The first segment consists of positive and negative terminals of capacitor 48 connected to the throw terminal of switch 46*b* and the pole terminal of switch 50*b*, respectively. The second segment consists of positive and negative terminals of supply 36 connected to the pole terminals of switches 46*b* and 44*b*, respectively. Connecting the throw terminals of switches 44*b* and 50*b* together completes the depiction of the second charging loop of FIG. 2 by FIGS. 7 and 8.

The discharging loop of FIG. 2 depicted at FIG. 7 includes first and second segments. The first segment consists of positive and negative terminals of capacitor 48 connected to the pole terminal of switch 52*b* and the throw terminal of switch 60*b*, respectively. The second segment consists of positive and negative terminals of capacitor 40 connected to the pole terminal of switch 60*b* and electrode 58, respectively. Connecting the throw terminal of switch 52*b* and electrode 54 together completes the depiction of the discharging loop of FIG. 2 by FIG. 7.

MOS FETs 44*a*, 52*a*, and 60*a* of FIG. 2 are power MOS FETs equal or equivalent to MOS FETs of a type including the prefix IRF manufactured by International Rectifier of El Segundo, Calif., U.S.A. Diodes 38*a*, 42*a*, 46*a*, and 50*a* of FIG. 2 are silicon rectifier diodes.

Operation-FIGS. 2 to 8

Signal 63 of FIG. 2 abruptly alternates between residence at first and second signal levels. With respect to the reference voltage taken at terminal 61 of FIG. 2, first and second signal levels are equal to, or nearly equal to the positive voltage of supply 36 of FIG. 2, $E_2$, and 0. volts, respectively.

Signal 63 applied to terminal 62 of FIG. 2, and residing at the first signal level, causes the source to drain connection of MOS FET 44*a*, and MOS FETs 60*a* and 52*a* to be rendered conductive and interrupted, respectively. Therefore, equivalent switches 44*b*, and 60*b* and 52*b* of FIG. 7 are closed and open, respectively. As a result of MOS FET 44*a* turned on, diodes 38*a*, 42*a*, 46*a*, and 50*a* are rendered conductive. Therefore equivalent switches 38*b*, 42*b*, 46*b*, and 50*b* of FIG. 7 are closed. FIG. 7 shows that the first and second charging, and the discharging loops of FIG. 2 are conductive and interrupted, respectively. Capacitors 40 and 48 at FIG. 7 are as a result depicted in a state of being charged in parallel.

Signal 63 applied to terminal 62 of FIG. 2, and residing at the second signal level, causes the source to drain connection of MOS FET 44*a*, and MOS FETs 60*a* and 52*a* to be interrupted and rendered conductive, respectively. Therefore, equivalent switch 44*b* of FIG. 8 is open. As an additional result, equivalent switches 60*b* of FIGS.3, 4 and 8 and 52*b* of FIGS. 5 to 6 and FIG. 8 are closed. Futhermore, referring to FIG. 2, MOS FET 44*a* turned off causes biasing of diodes 38*a*, 42*a*, 46*a*, and 50*a* by the voltage of supply 36 to be interrupted. Biasing of the diodes of FIG. 2 by charged capacitors 40 and 48 of FIG. 2 connected in series is explained by reference to FIGS. 3 to 6.

Shorting switches 64, 66, 68, and 70 are included at FIGS. 3, 4, 5, and 6, respectively, for the single purpose of explaining the function of the diodes of FIG. 2 rendered non-conductive, and thereby interrupting the four false discharging loops of the circuit of FIG. 2. Such shorting switches are not elements of any embodiment of my invention.

With switch 64 of FIG. 3 closed and shorting diode 46*a*, diode 38*a* is forward biased by the charge of capacitor 48 and the first false discharging loop of FIG. 3 is conductive. With switch 64 open, diode 46*a* is reverse biased and rendered non-conductive by the charge of capacitor 48, and the first false discharging loop is interrupted. Open switch 46*b* of FIG. 8 corresponds to diode 46*a* of FIG. 3 rendered non-conductive.

Also as a result of the source to drain connection of MOS FET 60*a* of FIG. 2 rendered conductive, with switch 66 of FIG. 4 closed and shorting diode 42*a*, diode 50*a* is forward biased by the charge of capacitor 40 and the second false discharging loop is conductive. With switch 66 open, diode 42*a* is reverse biased and rendered non-conductive by the charge of capacitor 40, and the second false discharging loop is interrupted. Open switch 42*b* of FIG. 8 corresponds to diode 42*a* of FIG. 4 rendered non-conductive.

As a result of the source to drain connection of MOS FET 52*a* of FIG. 2 rendered conductive, with switch 68 of FIG. 5 closed and shorting diode 50*a*, diode 42*a* is forward biased by the charge of capacitor 48 and the third false discharging loop is conductive. With switch 68 open, diode 50*a* is reverse biased and rendered non-conductive by the charge of capacitor 48, and the third false discharging loop is interrupted. Open switch 50*b* of FIG. 8 corresponds to diode 50*a* of FIG. 5 rendered non-conductive.

With switch 70 of FIG. 6 closed and shorting diode 38*a*, diode 46*a* is forward biased and rendered conductive by the charge of capacitor 40. Thereby, the fourth false discharging loop is conductive. With switch 70 open, diode 38*a* is reverse biased and rendered non-conductive by the charge of capacitor 40, and the fourth false discharging loop is interrupted. Open switch 38*b* of FIG. 8 corresponds to diode 38*a* of FIG. 6 rendered non-conductive.

As a result of the residence of signal 63 of FIG. 2 at the second level, then, corresponding FIG. 8 depicts the circuit of FIG. 2 including the first and second charging loops, and the discharging loop, interrupted and conductive, respectively. Shown at FIG. 8, the discharging loop of the circuit of FIG. 2 includes the filament of bulb 56.

In accordance with the method of operation of the circuit of FIG. 1, the peak voltage of capacitive discharge taken across electrodes 54 and 58 of bulb 56 of FIG. 2 is equal to 3.2 $V_l$nom. Where $e_C$pk is equated to the equal values of peak charged voltage of capacitors 40 and 48 of FIG. 2, then $$2e_C\text{pk}=3.2\ V_l\text{nom}.$$

The pulse width of the period of residence of signal 63 of FIG. 2 at the first signal level results in the condition, $$e_C\text{pk}=E^2-2\ V_d$$

and $V_d$ is equal to the contact potential of the four diodes of FIG. 2. $\text{Tau}_c$avg is equated to the time constant of the first and second charging loops of FIG. 2. The pulse width of the period of residence of signal 63 at the first signal level is equal to $5\text{tau}_c$avg., and greater than $5\text{tau}_C$avg., when the circuit of FIG. 2 provides illumination according to a first method of operation, and emergency flashing according to a second method of operation, respectively.

$\text{Tau}_d$avg. is equated to the time constant of the discharging loop of FIG. 2. For the circuit at FIG. 2 operated according to the first method, the pulse width of signal 63 residing at the second signal level is equal to $1.2\text{tau}_d$avg. Thereby, the PRR of signal 63 can be a maximum possible value approaching 14. HZ. Reducing the period of residence of signal 63 at the second signal level from being equal to 5taudavg. results in reduced drooping of the temperature of the filament of bulb 56 conforming to a proportional reduction of the PRR of signal 63. Therefore, in most cases, incomplete discharging of capacitors 40 and 48 is offset by an increase of the value of the temperature of the filament of bulb 56 when residence of signal 63 at the second signal level is initiated.

The circuit of FIG. 2 operated according to the second method includes the period of residence of signal 63 at the second signal level equal to $5\text{tau}_d$avg. The value of $\text{tau}_d$avg., with respect to the inverse of the PRR of signal 63 equal to 1. HZ, is negligible. Therefore, reducing the period of residence of signal 63 at the second signal level from being equal to $5\text{tau}_d$avg. does not reduce drooping of the temperature of the filament of bulb 56. Therefore, for the purpose of maximum utilization of the energy stored by capacitors 40 and 48 to heat the filament of bulb 56, capacitors 40 and 48 are fully discharged.

The proper and equal values of capacitance of capacitors 40 and 48 of the circuit of FIG. 2 are established by trial and error testing. Values of the PRR of signal 63 and the bulb-surface temperature of bulb 56 correspond to each trial value of capacitance of capacitor 40 and first or second methods of operation of the circuit of FIG. 2. A proper value of capacitance of capacitor 40 is selected when the resultant bulb-surface temperature of bulb 56 and the PRR of signal 63 are equal to corresponding values of reference bulb surface temperature and PRR of reference testing, respectively.

An advantage of the second compared to the first embodiments of my invention is that $E_2$ is slightly greater than one-half times the value of $E_1$. Peak voltage $e_C$pk of capacitors 24 of FIG. 1 and 40 of FIG. 2 are at the ratio of 2:1. Capacitor 24 charges to a peak voltage essentially equal to the voltage of source 20 of FIG. 1, $E_1$. Capacitor 40 charges to a peak voltage essentially equal to the difference of the voltages of the supply 36 of FIG. 2, $E_2$, and 2 $V_D$.

Description—FIG. 9

FIG. 9 shows the third and preferred embodiment of my invention including two sections, lighting circuit 112, and control signal generator and mechanical switching circuitry 114. Circuit 112 is identical to the circuit shown at FIG. 2, with the exception of five interconnections of circuit 112 and circuitry 114. A first interconnection is the negative terminals of capacitor 40, of circuit 112, and of first auxiliary capacitor 108, of circuitry 114, connected together. A second interconnection is negative terminals of capacitor 48, of circuit 112, and of second auxiliary capacitor 110, of circuitry 114, connected together. A third interconnection is the positive terminal of capacitor 40, of circuit 112, connected to throw terminal 94 of three pole, two position switch 88 of circuitry 114. A fourth interconnection is the positive terminal of capacitor 48, of circuit 112, connected to throw terminal 100 of switch 88. A fifth interconnection is output terminal 87 of astable multivibrator 72 of circuitry 114 connected to terminal 62 of circuit 112; therefore, at FIG. 9, astable multivibrator 72 generates signal 63.

Circuitry 114 includes first and second legs of positive and negative feedback loops of astable multivibrator 72. A first leg of the negative feedback loop comprises first and second terminals of first feedback resistor 76 connected to the anode terminal of first switching diode 74, and a first terminal of timing capacitor 79, respectively. A second terminal of capacitor 79 is connected to reference potential terminal 61. A second leg of the negative feedback loop includes first and second terminals of second feedback resistor 78 connected to the anode terminal of diode 75, and throw terminal 104, respectively; and pole terminal 102 connected to the first terminal of capacitor 79. A first leg of the positive feedback loop comprises first and second terminals of third feedback resistor 82 connected to the cathode terminal of second switching diode 80, and the first terminal of capacitor 79, respectively. A second leg of the positive feedback loop comprises first and second terminals of fourth feedback resistor 84 connected to the cathode terminal of diode 81, and terminal 104, respectively.

Operation-FIG. 9

A first setting of switch 88, as shown at FIG. 9, corresponds to the lighting device of FIG. 9 providing illumination. Pole terminal 90 and throw terminal 94 of switch 88 are not in contact, causing the positive terminals of capacitors 40 and 108 to be disconnected. Also, pole terminal 96 and throw terminal 100 of switch 88 are not in contact, disconnecting positive terminals of capacitors 48 and 110. Thereby, the value of total capacitance of the discharging loop of circuit 112 is equal to the capacitance of capacitors 40 and 48 connected in series. As a result of pole terminal 102 and throw terminal 104 of switch 88 contacting, the total resistance value of the negative feedback loop of astable multivibrator 72 is equal to the resistance value of resistors 76 and 78 connected together in parallel. An additional result is that the total resistance value of the positive feedback loop of astable multivibrator 72 is equal to the resistance value of resistors 82 and 84 connected together in parallel.

A second setting of switch 88 of FIG. 9 includes pole terminals 90 and 96 contacting throw terminals 94 and 100, respectively, and pole terminal 102 in contact with throw terminal 106, causing the lighting device of FIG. 9 to provide emergency flashing.

Pole terminal 90 contacting throw terminal 94 results in the positive terminals of capacitors 40 and 108 connected together. Pole 96 contacting throw terminal 100 causes positive terminals of capacitors 48 and 110 to be connected together. Thereby, the value of total capacitance of the discharging loop of circuit 112 is equal to the capacitance of capacitors 40 and 108 connected together in parallel, in series with capacitors 48 and 110 connected together in parallel. Pole terminal 102 not contacting throw terminal 104 results in the total resistance values of the positive and negative feedback loops of astable multivibrator 72 equal to the resistance values of resistors 82 and 76, respectively.

The lighting device of FIG. 9, alternately providing illumination and emergency flashing, includes the PRR of signal 63 of FIG. 9 about equal to 14. HZ and 1. HZ, respectively. Furthermore, drooping of the temperature of the filament of bulb 56 is inversely proportional to the PRR of signal 63. Therefore, the temperature of the filament of bulb 56, at the time point when signal 63 abruptly alternates from residence at the first signal level to residence at the second signal level, is directly proportional to the PRR of signal 63.

The average discharging time constant of circuit 112 of FIG. 9, $tau_d$avg., is directly proportional to the value of total capacitance of the discharging loop of circuit 112. The total capacitance of the discharging loop of circuit 112 is increased when switch 88 is rotated from the first setting to the second setting. As a result, $tau_d$avg. is also increased, and compensates for the corresponding relative decrease of the starting temperature of the filament of bulb 56 at the time point when discharge lighting of circuit 112 is initiated.

The period of residence of signal 63 of FIG. 9 at the first signal level is directly proportional to the total resistance value of the positive feedback loop of astable multivibrator 72. Rotating switch 88 from first to second settings alternates the total resistance value of the positive feedback loop of astable multivibrator 72 from equal to the resistance value of resistors 82 and 84 connected together in parallel, to equal to the resistance value of resistor 82. As a result, the period of residence of signal 63 at the first signal level is increased, corresponding to alternation of the PRR of signal 63 from about equal to 14. HZ, to about equal to 1. HZ.

The period of residence of signal 63 of FIG. 9 at the second signal level is directly proportional to the total resistance value of the negative feedback loop of astable multivibrator 72. Rotating switch 88 from first to second settings alternates the total resistance value of the negative feedback loop of astable multivibrator 72 from equal to the resistance value of resistors 82 and 84 connected together in parallel, to equal to the resistance value of resistor 82. As a result, the period of residence of signal 63 at the second signal level can be increased, from equal to 1.2 $tau_d$avg., to equal to 5$tau_d$avg. Also, rotating switch 88 from first to second settings causes an increase of the value of $tau_d$avg. Therefore, the required term of residence of signal 63 at the second signal level equal to $tau_d$avg. also increases.

SUMMARY, RAMIFICATIONS, AND SCOPE

Thus the reader will see that the portable self-powered lighting device of my invention is economical with respect to alternately providing higher intensity of illumination than that of the prior art for a period of service normally associated with such portable self-powered lighting devices, or emergency flashing. In addition, the lighting device of my invention provides illumination with some flickering, such flickering increasing the extent of alerting others in the selfsame area as the user of the lighting device to the presence of the user.

While my above description contains many specificities, these should not be construed as limitations on the scope of the invention, but rather as as exemplification of three embodiments thereof. Many other variations are possible. For example, where the lighting device of my invention includes a plurality of capacitors charged in parallel, and discharged in series, such plurality can be of a quantity greater than two. Also, for the purpose of attaining a PRR of peak luminous flux emission equal to or greater than 14. HZ, the lighting device of my invention can include incomplete charging of the energy storing capacitor(s) of the device. Further, the method of capacitive discharge- lighting of an incandescent lamp is not limited to the lighting of miniature incandescent lamps.

The spectral characteristics of illumination provided by incandescent lamps and strobe or flash tubes are termed warm and cold, respectively. The lighting device of my invention can provide a brief illumination of relatively moderate intensity that includes the characteristic of warmth, for flash photography, as opposed to the characteristic of cold illumination provided by flash tubes commonly providing momentary high-intensity illumination for such photography.

Accordingly, the scope of my invention should be determined not on the basis of the embodiments shown and described, but on the basis of the appended claims and their legal equivalents.

I claim:

1. A method for generating a momentary peak emission of luminous flux by an incandescent lamp, including:

(a) applying a capacitive discharge across a first electrode and a second electrode of said incandescent lamp, (b) setting the ratio of the values of the peak voltage of said capacitive discharge with respect to the nominal direct current voltage of said incandescent lamp at about equal to 3.2, and (c) with respect to the repetition rate of said capacitive discharge, setting the time constant and extent of the discharge of said capacitive discharge resulting in equal values of the momentary peak and nominal direct current temperature of the filament of said incandescent lamp, whereby the ratio of the values of said momentary peak emission of luminous flux with respect to the nominal direct current luminous flux emission of said incandescent lamp is generally greater than 2:1, and the service life compared to the nominal direct current service life of said incandescent lamp is only moderately reduced.

2. The method of claim 1, wherein said incandescent lamp is a miniature lamp.

3. The method of claim 2, wherein a first repetition rate of said capacitive discharge is about equal to 14. HZ.

4. The method of claim 3, further including interrupting said application of said capacitive discharge when the voltage of said capacitive discharge is equal to the product of the inverse of 3.2 and said peak voltage of said capacitive discharge, whereby said peak voltage can be nearly equal to the voltage of a direct current power supply providing for said capacitive discharge, whereby the periods of image retention by the human eye of said momentary peak emission of luminous flux overlap, and a constant illumination of an intensity equal to the intensity of illumination provided by said momentary peak emission of luminous flux can be perceived.

5. The method of claim 2, wherein a second repetition rate of said capacitive discharge is about equal to 1. HZ.

6. The method of claim 5, further including interrupting said application of said capacitive discharge when said capacitive discharge is nearly complete, whereby the energy of said capacitive discharge is advantageously fully utilized to heat the filament of said miniature incandescent lamp, and said peak voltage of said capacitive discharge is equal to said voltage of said direct current power supply, and whereby the repetition rate of said emission of peak luminous flux is equal to said second repetition rate of said capacitive discharge, and the method of claim 5 provides emergency flashing.

7. The circuit of a lighting device, comprising:

(a) a direct current power supply, (b) a set of capacitors, for energy storage and subsequent release, including connecting together of the positive and negative terminals of the capacitors composing said set of capacitors, respectively, (c) an incandescent lamp, (d) first and second switches, equal to, or operating in a similar manner as a mechanical, single pole, single throw switch, (e) a charging loop, comprising first and second terminals of said direct current power supply connected to a first terminal of said first switch, and a first terminal, of a polarity equal to the polarity of said second terminal of said direct current power supply, of said set of capacitors, respectively; and a second terminal of said first switch connected to the second terminal of said set of capacitors, (f) a discharging loop, comprising first and second electrodes of said incandescent lamp connected to a first terminal of said second switch, and said first terminal of said set of capacitors, respectively; and the second terminal of said second switch connected to said second terminal of said set of capacitors, (g) a first state of said first and second switches, including the connecting together and disconnecting of said first and second terminals of said first and second switches, respectively, (h) a second state of said first and second switches, including the disconnecting and connecting together of said first and second terminals of said first and second switches, respectively, (i) the ratio of the value of the peak voltage taken across said first and second terminals of said set of capacitors, with respect to the nominal direct current voltage of said incandescent lamp, is about equal to 3.2, and (j) with respect to the value of the repetition rate of said second state, the duration of said second state and the discharging time constant of said discharging loop cause the momentary peak and nominal direct current temperatures of the filament of said incandescent lamp to be equal, whereby, the ratio of the values of the peak luminous flux emission with respect to the nominal direct current luminous flux emission of said incandescent lamp is generally greater than 2:1, and the service life compared to the nominal direct current service life of said incandescent lamp is only moderately reduced.

8. The circuit of claim 7, wherein a first repetition rate of said second state of said first and second switches is about equal to 14. HZ.

9. The circuit of claim 8, further including a first duration of said second state of said first and second switches so that the discharge of said set of capacitors is interrupted when the voltages taken across said first and second electrodes and of said nominal direct current of said incandescent lamp are equal, whereby said peak voltage taken across said first and second terminals of said set of capacitors can be very nearly equal to the voltage of said direct current power supply, and whereby the periods of image retention by the human eye of said momentary peak emission of luminous flux overlap, and a constant illumination of an intensity equal to the intensity of illumination provided by said momentary peak emission of luminous flux can be perceived.

10. The circuit of claim 7, wherein a second repetition rate of said second state of said first and second switches is about equal to 1. HZ.

11. The circuit of claim 10, further including a second minimal duration of said second state of said first and second switches so that said discharging loop is interrupted when said voltage taken across said first and second electrodes of said incandescent lamp is nearly equal to 0. Volts, whereby said energy storage of said set of capacitors is advantageously fully utilized to heat the filament of said incandescent lamp, and said peak voltage taken across said first and second terminals of said set of capacitors can be equal to said voltage of said direct current power supply, and whereby the repetition rate of said peak emission of luminous flux is equal to said second repetition rate of said second state of said first and second switches, and the circuit of claim 10 provides emergency flashing.

12. The circuit of claim 7, wherein said first and second switches are field effect transistors.

13. The circuit of claim 12, wherein said repetition rate and duration of said second state of said first and second switches is controlled by the application of a square wave signal to the control terminals of said first and second field effect transistors.

14. The circuit of a lighting device, comprising:

(a) a direct current power supply, (b) a plurality of sets of capacitors, for energy storage and subsequent release, including connecting together of the positive and negative terminals of the capacitors composing each set of said plurality of sets of capacitors, respectively, (c) an incandescent lamp, (d) a switching means for alternately charging and discharging said plurality of sets of capacitors connected in parallel and in series, respectively, (e) a charging loop comprising connecting together the positive and negative terminals of said direct current power supply and said plurality of sets of capacitors, respectively, (f) a discharging loop comprising connecting together of said plurality of sets of capacitors in series, and first and second electrodes of said incandescent lamp connected to first and second terminals at opposite ends of said plurality of sets of capacitors connected together in series, respectively, (g) a first state of said switching means causing said charging and discharging loops to be conductive and interrupted, respectively, (h) a second state of said switching means causing said charging and discharging loops to be interrupted and conductive, respectively, (i) the ratio of the value of the peak voltage taken across said first and second terminals at opposite ends of said plurality of sets of capacitors connected together in series, with respect to the nominal direct current voltage of said incandescent lamp, is about equal to 3.2, and (j) with respect to the value of the repetition rate of said second state of said switching means, the duration of said second state of said switching means and the discharging time constant of said discharging loop cause the momentary peak and nominal direct current temperatures of the filament of said incandescent lamp to be equal, whereby, the ratio of the values of the peak luminous flux emission with respect to the nominal direct current luminous flux emission of said incandescent lamp is generally greater than 2:1, and the service life compared to the nominal direct current service life of said incandescent lamp is only moderately reduced.

15. The circuit of claim 14, wherein-a first repetition rate of said second state of said switching means is about equal to 14. HZ.

16. The circuit of claim 15, further including a first duration of said second state of said switching means so that the discharge of said plurality of sets of capacitors is interrupted when the voltages taken across said first and second electrodes and of said nominal direct current of said incandescent lamp are equal, whereby the peak voltage taken across the positive and negative terminals of each set of capacitors of said plurality of sets of capacitors can be very nearly equal to the voltage of said direct current power supply, and whereby the periods of image retention by the human eye of said momentary peak emission of luminous flux overlap, and a constant illumination of an intensity equal to the intensity of illumination provided by said momentary peak emission of luminous flux can be perceived.

17. The circuit of claim 14, wherein a second repetition rate of said second state of said switching means is about equal to 1. HZ.

18. The circuit of claim 17, further including a second minimal duration of said second state of said switching means so that said discharging loop is interrupted when said voltage taken across said first and second electrodes of said incandescent lamp is nearly equal to 0. Volts, whereby said energy storage of said plurality of sets of capacitors is advantageously fully utilized to heat the filament of said incandescent lamp, and said peak voltage taken across said positive and negative terminals of each set of capacitors of said plurality of sets of capacitors can be equal to said voltage of said direct current power supply, and whereby the repetition rate of said peak emission of luminous flux is equal to said second repetition rate of said second state of said switching means, and the circuit of claim 17 provides emergency flashing.

19. The circuit of claim 14, further including:

(a) first and second field effect transistors of opposite type of channel, (b) additional field effect transistors of the type of channel identical to the type of channel of said second field effect transistor, (c) a plurality of rectifier diodes, (d) said charging loop, including said positive and negative terminals of each set of capacitors of said plurality of sets of capacitors connected to the cathode and anode terminals of first and second diodes of said plurality of rectifier diodes, respectively; the anode terminals of said first diodes connected together, and the cathode terminals of said second diodes connected together; said first and second terminals of said direct current power supply connected to a first termination of said plurality of diodes connected together, and a first channel terminal of said first field effect transistor, respectively; and a second channel terminal of said first field effect transistor connected to a second termination of said plurality of rectifier diodes connected together, (e) said discharging loop, including said first and second terminals at opposite ends of said plurality of sets of capacitors connected in series connected to said first electrode of said incandescent lamp, and a first channel terminal of said second field effect transistor, respectively, and said second electrode of said incandescent lamp connected to a second channel terminal of said second field effect transistor; and adjacent positive and negative terminals of first and second sets of capacitors of said plurality of sets of capacitors connected in series connected to first and second channel terminals of one of said additional field effect transistors, respectively.

20. The circuit of claim 19, wherein said repetition rate and duration of said second state of said switching means is controlled by the application of a square wave signal to the control terminals of said first, second, and additional field effect transistors.

* * * * *

UNITED STATES PATENT AND TRADEMARK OFFICE

CERTIFICATE OF CORRECTION

PATENT NO. : 6,066,925
DATED : May 23, 2000
INVENTOR(S) : Peter H. Lehman

It is certified that error appears in the above-identified patent and that said Letters Patent is hereby corrected as shown below:

Title page,
Should be replaced with the attached title page.

The drawing sheets, consisting of Figures 1-9, should be deleted and replaced with the drawing sheets, consisting of Figures 1-9, as shown on the attached pages.

Column 8,
Line 57, delete "and 8".
Line 57, change "Figs." to -- Fig. --.
Line 58, change "7" to -- 8 --.
Line 67, change "7" to -- 8 --.

Signed and Sealed this

Twenty-sixth Day of March, 2002

*Attest:*

*Attesting Officer*

JAMES E. ROGAN
*Director of the United States Patent and Trademark Office*

United States Patent [19]

Lehmann

[11] Patent Number: 6,066,925

[45] Date of Patent: May 23, 2000

[54] CAPACITIVE DISCHARGE-LIGHTING OF AN INCANDESCENT LAMP

[76] Inventor: Peter H. Lehmann, 8723 West Chester Pike, Upper Darby, Pa. 19082

[21] Appl. No.: 08/892,388

[22] Filed: Jul. 14, 1997

[51] Int. Cl.[7] ..... H05B 37/00

[52] U.S. Cl. ..... 315/200 A; 315/291; 315/209 R; 315/241 R

[58] Field of Search ..... 315/209 R, 194, 315/208, 246, 291, 241 R, 241 S, 200 A; 362/293, 184

[56] References Cited

U.S. PATENT DOCUMENTS

| | | | |
|---|---|---|---|
| 3,824,447 | 7/1974 | Kuwabara | 321/15 |
| 4,097,782 | 6/1978 | Chambliss | 315/209 R |
| 4,200,823 | 4/1980 | Keeran et al. | 315/241 R |
| 4,835,665 | 5/1989 | Kao | 362/184 |

*Primary Examiner*—Don Wong
*Assistant Examiner*—Haissa Philogene

[57] ABSTRACT

The peak voltage of a periodic capacitive discharge, applied across first and second electrodes of the incandescent lamp, is about equal to the nominal DC voltage of the lamp multiplied by 3.2. The repetition rate of discharging, the extent of charging and discharging, and the value of the capacitance producing the periodic discharge result in the values of momentary peak and nominal temperature of the filament of the lamp being equal. Thereby, the value of peak luminous flux emission with respect to the nominal luminous flux emission of the lamp is several times greater. Where the discharge is periodic at a rate equal to about 14. HZ, then luminous flux emission by the lamp appears to the human eye to be continuously bright at an intensity equal to the peak value of luminous flux emission of the lamp, and the emission of the lamp is suitable for providing illumination. Emission of the lamp is suitable for providing emergency flashing where the discharge is periodic at a rate equal to about 1. HZ. A plurality of capacitors charged in parallel and discharged in series, as opposed to charging and discharging a single capacitor, can reduce the necessary voltage of the power supply providing the capacitive charge.

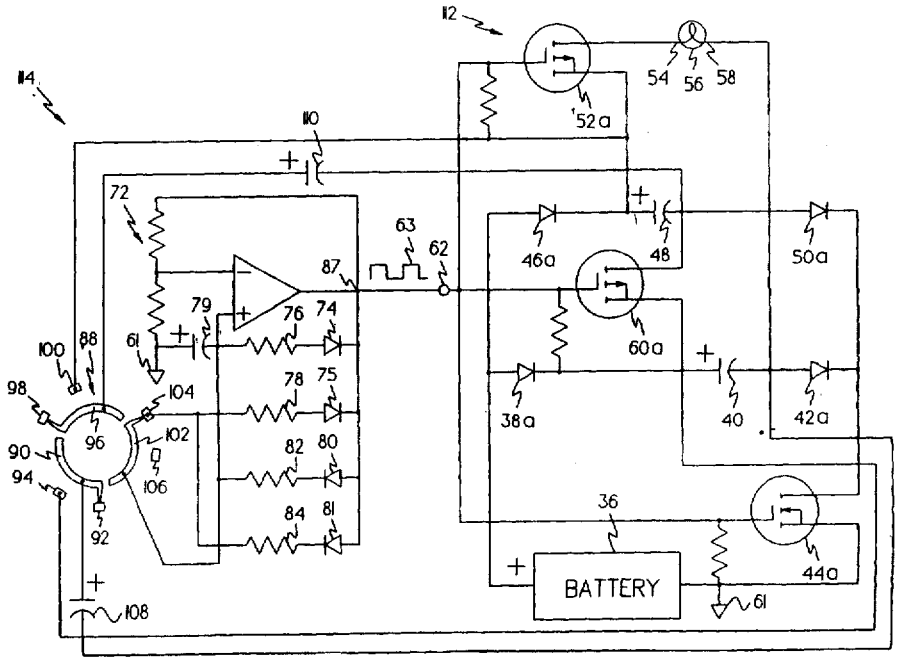

20 Claims, 5 Drawing Sheets